United States Patent [19]

Patel

[11] 4,357,822

[45] Nov. 9, 1982

[54] CRIMPING COLLET

[75] Inventor: Hiralal V. Patel, Mentor, Ohio

[73] Assignee: Dana Corporation, Toledo, Ohio

[21] Appl. No.: 191,955

[22] Filed: Sep. 29, 1980

[51] Int. Cl.[3] ..... B21D 41/00

[52] U.S. Cl. ..... 72/402; 29/237

[58] Field of Search ..... 72/402, 410, 453.01, 72/453.15, 453.16, 416, 412; 29/237, 517; 279/1 Q, 51

[56] References Cited

U.S. PATENT DOCUMENTS

| | | | |
|---|---|---|---|
| 2,346,706 | 4/1944 | Stoner | 279/46 |
| 2,374,245 | 4/1945 | Stoner | 279/46 |
| 2,459,899 | 1/1949 | Stoner | 279/1 Q |
| 3,325,166 | 6/1967 | McCarthy | 279/1 Q |
| 3,750,452 | 8/1973 | Frank | 29/237 |
| 3,762,209 | 10/1973 | Herndon | 29/237 |
| 3,851,514 | 12/1974 | Chen | 29/237 |
| 4,014,202 | 3/1977 | Van Allen | 29/237 |
| 4,034,593 | 7/1977 | Patel | 72/402 |

*Primary Examiner*—Gene Crosby

*Attorney, Agent, or Firm*—Pearne, Gordon, Sessions, McCoy & Granger

[57] ABSTRACT

A collet assembly for a hose crimping tool is disclosed in which rigid metal jaw elements are encircled by and locked within a separately molded elastomeric cage. The cage positions the elements in the free state and allows them to be radially compressed for the crimping operation. Interlocking surfaces are provided to retain the jaws within the cage without need of adhesives, or the like.

8 Claims, 8 Drawing Figures

CRIMPING COLLET

BACKGROUND OF THE INVENTION

This invention relates generally to machines for crimping hose fittings or the like, and more particularly to a novel and improved collet assembly for such crimping machines and to a novel and improved method of forming such collet assemblies.

PRIOR ART

U.S. Pat. No. 3,750,452, issued to Frank (assigned to the assignee of the present invention and incorporated herein by reference) discloses a collet assembly for use in hose crimping machines in which separate rigid jaws are connected by an elastomeric material to form a collet assembly. Such collet assemblies are formed by machining the metal jaw elements as an assembly, which is subsequently cut apart to produce a set of individual matched jaws. The set of jaws are then placed in a mold and elastomeric material is molded between and bonded to the jaw elements to produce the assembly. The elastomeric material operates to position the jaw elements prior to crimping and allows radially inward crimping movement when the collet assembly is pressed in along a tapered bore in a die.

In such patent, various configurations are illustrated and the collet assembly is formed in two parts so that it can be assembled around an elbow fitting.

SUMMARY OF THE INVENTION

In accordance with the present invention, a collet assembly includes an elastomeric cage which is separately molded with a shape which permits the assembly of separate jaws into the cage. The jaws in the cage are shaped so that each jaw is encircled by the elastomeric material of the cage. Further, the elastomeric material and jaws are formed with opposed mating surfaces along opposite sides of each jaw, which lock each of the jaw elements in the proper position within the cage.

Preferably, adhesive or the like is not used to bond the jaws in the cage so that the parts may be diassembled if a given part becomes damaged or worn and the remaining good parts of the assembly can be then reassembled with a new replacement part.

It is also preferable to form the jaws by precision molding processes such as a powdered metal process. With such procedure, the jaws can be very accurately produced at low cost.

The collet assemblies, when positioned in a die having a tapered or conical bore, provide mating surfaces along the periphery of the collet assembly formed by the jaw elements. The crimping operation itself is accomplished by axially pressing the collet assembly along the tapered bore in the die, with a force applied to one end face of the collet assembly. Preferably, such end face is formed with a recess along which the mating portion of the cage material extends. With such structure, the exposed portion of the cage material does not project beyond the end faces of the jaw elements, so that forces applied to the jaw elements do not damage the cage material.

BRIEF DESCRIPTION OF THE DRAWINGS

FIG. 8 is an end view of a second embodiment of a collet cage in which the cage is molded of a single piece having a single lateral cut at one side so that the assembled collet can be expanded to slip over a hose fitting or the like.

DETAILED DESCRIPTION OF THE PREFERRED EMBODIMENT

Figure 1:
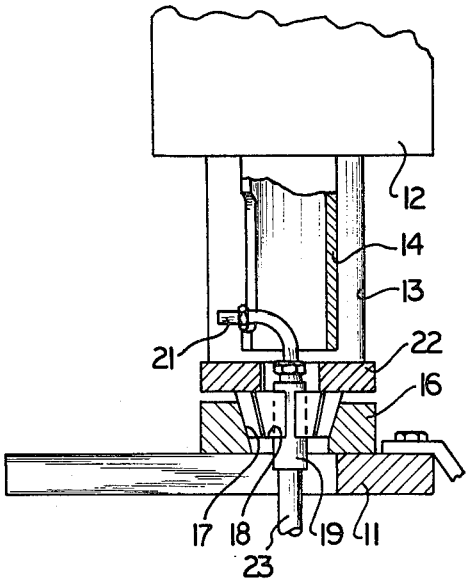
FIG. 1 is a side elevation, partially in longitudinal section, illustrating a crimping machine with a collet assembly in accordance with the present invention installed therein.

FIG. 1 illustrates a collet in accordance with the present invention in use in a crimping machine of the type disclosed in the Frank patent, supra. Such machine includes a bed plate 11 on which an upper housing 12 is supported by columns 13. Mounted in the upper housing 12 is a hydraulic cylinder (not illustrated) which operates to drive a ram 14 downwardly to provide the crimping force.

The crimping tooling per se includes a die ring 16 which rests on the bed plate 11 and is formed with a tapered central bore 17 therein which provides an inwardly facing conical wall surface.

Positioned within the tapered bore 17 is a collet assembly 18 which is positioned around an uncrimped hose fitting 19. The particular fitting illustrated is provided with an elbow 21. A pressure ring 22 is positioned to be pushed down by the ram 14 and to force the collet assembly 18 down along the tapered bore to perform the crimping operation on the fitting 19. As the ram 14 drives the collet assembly downwardly along the tapered bore 17, the collet assembly is caused to press inwardly against the outer sleeve of the fitting to crimp the it against the hose 23 to compress the hose material against an internal nipple.

Referring now to FIGS. 2 through 8, the collet assembly 18 consists of two elastomeric cage segments 26 and a plurality of rigid jaws 27. The cage segments are perferably injection-molded and the rigid jaws 27 are preferably molded to the shape illustrated in the drawings by a powdered metal process. In the embodiment of FIGS. 4 through 7, the collet assembly includes two semicircular cage segments 26 and eight jaw elements 27, with four jaw elements 27 mounted in each of the cage segments 26.

Each cage segment 26 is provided with a lower, arcuate or semicylindrical end portion 28, a plurality of wedge-shaped jaw separators 29, and an arcuate or semicylindrical upper end portion 31, which join the upper ends of the jaw separators 29. Adjacent separators cooperate with end portions to define openings which receive jaws so that they are encircled by the various parts of the cage. The three central jaw separators 29 have a thickness in a peripheral direction twice the thickness of the end jaw separators 29*a*, so that when one cage segment 26 is positioned opposite a mating cage segment with the end faces 32 of one segment engaging the end faces 32 of the other segment, the two end jaw separators which abut combine to have a total thickness in a peripheral direction equal to the thickness of the central jaw separators 29.

Between each jaw separator 29 and extending upwardly from the lower end portion 28 is a cylindrical projection 33.

Each of the rigid jaw elements 27 is formed with a rearward face 34 which is a portion of a cone and is shaped to mate with the surface of the tapered bore 17. The inward face or surface 36 of each jaw element is formed in the shape of a portion of a cylinder extending from the upper surface 37 to a location at 38 spaced from the lower surface 39 of the jaw element. The radius of curvature of the inner side surface 36 is selected so that when all of the jaw elements are compressed to the fully crimped position, the surfaces 36 cooperate to form a an interrupted cylinder.

Figure 7:
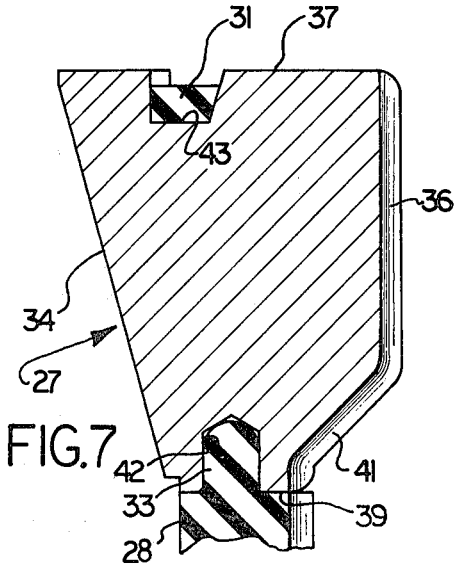
FIG. 7 is an enlarged cross section taken along line 7—7 of FIG. 3, illustrating the interlocking mating surfaces on opposite ends of the jaw elements which lock the jaw elements in the cage.

Below the location 38, the jaw element is formed with a flaring or inclinded wall portion 41. Each jaw element 26 is provided with an upwardly extending cavity 42 open to the lower end portion 28 and adapted to receive associated projections 33 with a close fit. The cavity 42 is axially below the surface 36 so that the cavity does not weaken the jaw along the zone of crimping loads. The upper end of each jaw element 27 is provided with a curved groove 43 extending downwardly from the upper surface 37 and shaped and positioned to receive the associated part of the upper end portion 31. The depth of the groove 43 is selected to be about twice the axial thickness of the upper end portion 31 so that when the upper end portion 31 is positioned in the groove 43, its upper surface is spaced a substantial distance below the upper surface 37, as best illustrated in FIG. 7. With such proportions, in which the upper end portion 31 of the cage is spaced downwardly from the upper end surface 37 of the jaw, the end portions 31 do not engage the pressure ring 22 to any appreciable extent when the crimping operation is performed. This minimizes the tendency for the pressure ring 22 to damage the cage 26.

Figure 2:
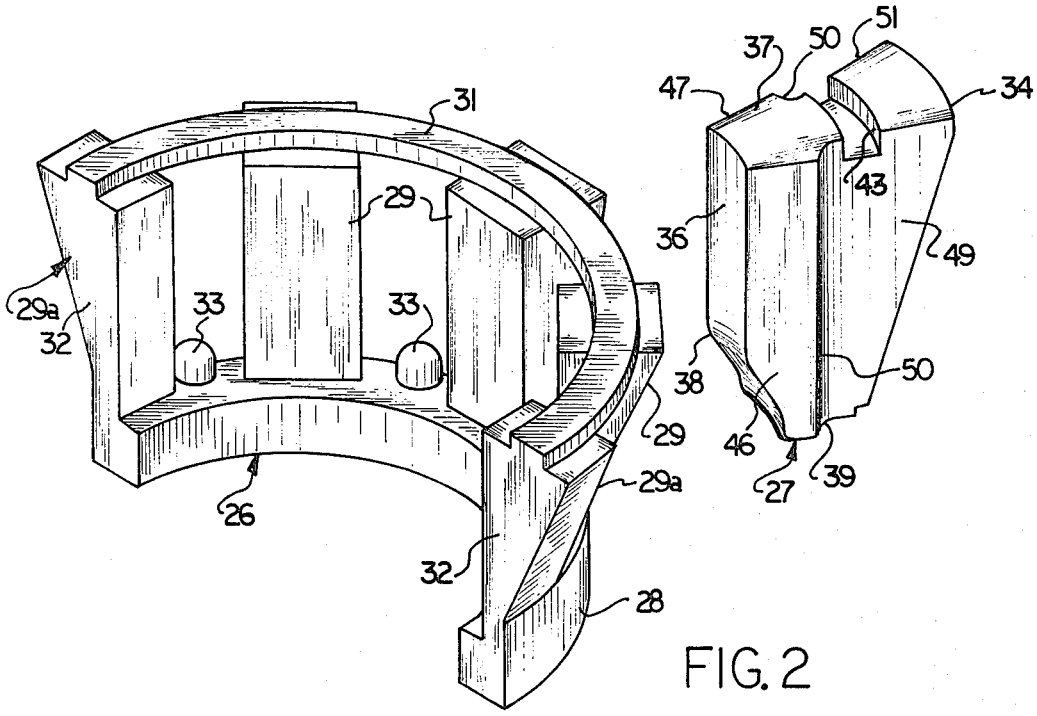
FIG. 2 is an enlarged, exploded, perspective view, illustrating a cage segment and a jaw element in the disassembled condition.
Figure 3:
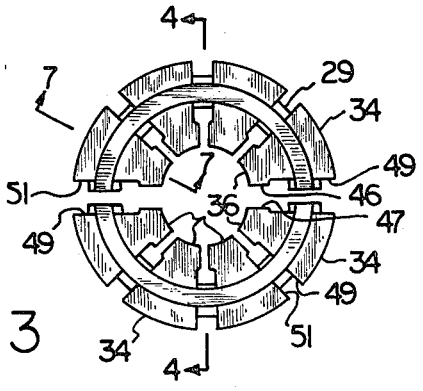
FIG. 3 is an end view of a collet assembly embodiment in which there are two semicylindrical subassemblies which cooperate to form a complete assembly.
Figure 4:
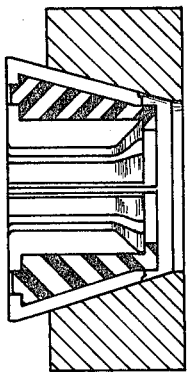
FIG. 4 is a cross section taken generally along line 4—4 of FIG. 3 illustrating the collet assembly of FIG. 3 positioned in a die.
Figure 5:
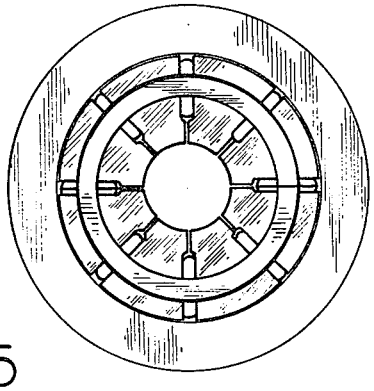
FIG. 5 is an end elevation illustrating the collet assembly and die at the completion of the crimping operation, with the fitting removed for purposes of illustration.
Figure 6:
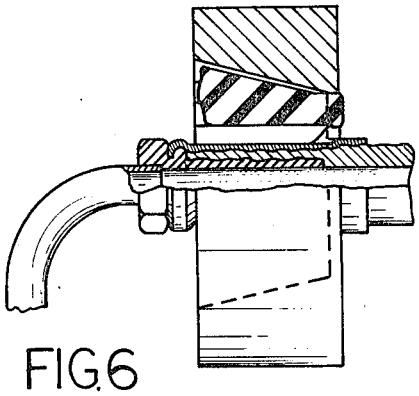
FIG. 6 is a side elevation similar to FIG. 4, but illustrating the collet assembly in a crimped position around a hose fitting.

The side faces of the jaw elements have a shape best illustrated in FIGS. 2, 3, and 5. Extending back from the inward face 26, each jaw element is provided with a substantially radial sidewall portion 46 and 47. Each such wall portion 46 and 47 extends substantially perpendicular to the adjacent portion of the inward face 36 so that they extend substantially radially with respect to the central axis of the collet assembly when the collet assembly is in the fully closed and crimped position of FIG. 5.

Outwardly of the wall portions 46 and 47, the jaws are provided with offset shoulder 50 and, wedge-shaped sidewalls 49 and 51. The wall portion 49 of one jaw element is parallel to and spaced from the wall portion 51 of the adjacent jaw element. This parallel relationship between the two wall portions 49 and 51 is maintained between the release or unclamped position of FIG. 3 and the fully crimped and clamped condition of FIG. 5.

When the cage elements are substantially unrestrained and the jaw elements are installed in the cage, the spacing between the two wall portions 49 and 51 is substantially equal to the peripheral width of each of the jaw separators 29. However, when the collet assembly is pressed down in along the die ring to a position illustrated in FIGS. 5 and 6, the jaw separators 29 are compressed. For this reason, the radial extent of each of the wall portions 49 and 51 is greater than the radial extent of the corresponding portion of the jaw separators 29 to allow for the compression illustrated in FIGS. 5 and 6. In fact, the jaw separators are perferably sized and shaped so that in the fully compressed condition they do not extend between the inner wall portions 46 and 47, and do not extend outwardly into engagement with the surface of the ring die. Further, the upper surface of the upper end portions 31 should be spaced below the end faces 37 of the assembled jaw elements, so that when the collet assembly is fully compressed the upper surface of the end portion 31 does not extend beyond the surface 37 but is preferably recessed below the surface 37 so that damage to the cage elements does not result from the operation of the collet assembly for crimping.

Figure 8:
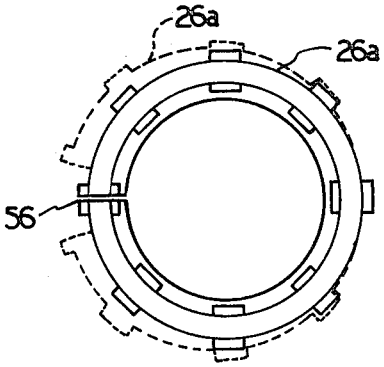

FIG. 8 illustrates a second embodiment in which a cage 26*a* is formed of a single piece having a radial opening at 56 so that the collet assembly can be opened, as indicated by the phantom position, to slip over a fitting having an elbow or the like. With this structure, a single collet is provided instead of the two-piece collet assembly of the prior embodiment. Otherwise, the embodiment of FIG. 7 is essentially the same as the embodiment of FIGS. 1 through 7.

With the present invention, the elastomeric cage can be formed by simple injection molding at a fraction of the cost of molding the assembly around the jaw elements, as disclosed in the Frank patent, supra. Further, with the present invention, a wider range of elastomeric materials may be used because it is not necessary to adhere the cage to the jaw elements. It is only necessary to form the collets of an elastomeric material which is sufficiently elastic to allow the jaws to be inserted into the cages so that each jaw element is fully encircled by the associated cage and which is capable of withstanding the crimping operation. The elasticity required of the cage material is that elasticity which permits the upper end portions 21 to be stretched up over the upper surface of the jaw element until they are in a position to snap down into the associated groove. The groove 43, in combination with the inner and outer surfaces of the upper end portions 31, provides opposed mating surfaces at one end of the jaw element which cooperate with the opposed mating surfaces provided by the projections 33 and recesses 42 at the lower end of the jaw elements to firmly lock the jaw elements in the assembled position. It should also be noted from an inspection of FIG. 3 that the rearward ends of the sidewall portions 46 and 47 of a given jaw element are spaced apart by a distance which is not substantially greater than the spacing between the jaw separators 29 so that the jaws can be easily slipped into the assembled position between the jaw separators.

With the present invention, it is preferable to form the jaw elements by powdered metallurgy processes in which it is possible to accurately mold the rather complex shape of the jaw elements in a uniform manner. With such manufacturing procedure, the cost of a given jaw element is substantially less than the cost of such element formed by machining. Further, a greater degree of uniformity in size is achieved, so it is not necessary to produce matched sets of jaw elements.

Since the jaw elements are mechanically positioned in the associated cages, it is not necessary to use an adhesive to assemble the collet. Further, because adhesives are not used, it is possible to disassemble a collet to remove a damaged element therefrom and to allow it to be replaced with an undamaged element. For example, if a given cage becomes worn or damaged before the associated jaw elements are worn out, the jaw elements may be removed from the cage and installed in a new undamaged or unworn cage. This allows greater use of the elements and facilitates easy repair of the collet.

Although the preferred embodiments of the invention have been shown and described, it should be understood that various modifications and rearrangements of the parts may be resorted to without departing from the scope of the invention as disclosed and claimed herein.

What is claimed is:

1. A crimping apparatus comprising a die having a tapered bore and a collet assembly operable to crimp a workpiece when moved axially alond said tapered bore, said collet assembly including a plurality of rigid jaw elements and a separately formed elastomeric cage encircling and releasably receiving each of said jaw elements in said assembly, each of said jaw elements having recess means located at opposite axially inner and outer ends, said cage having mating axially inner and outer peripherally extending portions in said recess means which interlock said cage and each of said jaw elements together, said cage also providing separator portions between each pair of adjacent jaw elements, said separator portions extending axially between and joining said axially inner and outer peripherally extending portions, said cage when unstressed maintaining a predetermined spacing between adjacent jaws and allowing radially inward movement when said collet is pressed into said tapered bore.

2. A crimping apparatus as set forth in claim 1, wherein the recess means at the axially outer ends of said jaw elements comprises a groove extending between the sides thereof, and said outer peripherally extending portion of said cage is positioned in said groove.

3. A crimping apparatus as set forth in claim 2, wherein said groove has an axial depth substantially greater than the axial thickness of said outer peripherally extending end portion so that said cage is spaced inwardly from the outer ends of said jaws.

4. A crimping apparatus as set forth in claim 3, wherein a pressure ring engages the outer ends of said jaw elements to press said collet in along said tapered bore without substantial engagement with said cage.

5. A crimping apparatus as set forth in claim 4, wherein said recess means at said inner end of each of said jaw elements is provided by an axial bore formed in said jaw elements and an axial projection formed on said inner peripheral portion of said cage extends into said bore.

6. A crimping apparatus as set forth in claim 5, wherein said jaw elements provide axially extending crimping surfaces adapted to engage and crimp a hose fitting, and said axial bore is located axially beyond the end of said crimping surface.

7. A crimping apparatus as set forth in claim 6, wherein said jaw elements and cage are free of adhesive bonds to permit assembly and disassembly of said collets.

8. A crimping apparatus as set forth in claim 1, wherein said recess means at said inner end of each of said jaw elements is provided by an axial bore formed in said jaw element and an axial projection formed on said inner peripheral portion of said cage extends into said axial bore.

* * * * *